US011326339B2

(12) United States Patent
Cho

(10) Patent No.: US 11,326,339 B2
(45) Date of Patent: May 10, 2022

(54) TETRIS HOUSE

(71) Applicant: DEAR ARCH CO., LTD., Seoul (KR)

(72) Inventor: Han Moo Cho, Incheon (KR)

(73) Assignee: DEAR ARCH CO., LTD., Seoul (KR)

( * ) Notice: Subject to any disclaimer, the term of this patent is extended or adjusted under 35 U.S.C. 154(b) by 0 days.

(21) Appl. No.: 17/068,828

(22) Filed: Oct. 12, 2020

(65) Prior Publication Data

US 2022/0112707 A1 Apr. 14, 2022

(51) Int. Cl.

*E04B 1/24* (2006.01)
*E04B 1/348* (2006.01)
*E04C 3/04* (2006.01)

(52) U.S. Cl.

CPC ..... *E04B 1/2403* (2013.01); *E04B 1/3483* (2013.01); *E04C 3/04* (2013.01); *E04B 2001/2406* (2013.01); *E04B 2001/2418* (2013.01); *E04B 2001/2421* (2013.01); *E04B 2001/2451* (2013.01); *E04B 2001/2466* (2013.01); *E04C 2003/0465* (2013.01)

(58) Field of Classification Search

CPC ..... E04B 1/2403; E04B 1/3483; E04B 2001/2451; E04B 2001/2421; E04B 2001/2418; E04B 2001/2406; E04B 2001/2466; E04C 3/04; E04C 2003/0465

USPC ..... 52/106, 309.1, 309.4, 834, 404.1, 407.1, 52/407.3, 742.1

See application file for complete search history.

(56) References Cited

U.S. PATENT DOCUMENTS 3,332,170 A * 7/1967 Bangs ..... B61D 17/18 49/400
3,719,049 A * 3/1973 Shaw ..... B63B 59/00 405/216
5,085,897 A * 2/1992 Luckanuck ..... C04B 28/26 106/600
6,678,901 B1 * 1/2004 La Rossa ..... E04H 4/144 150/154
2002/0069600 A1 * 6/2002 Bryant ..... E04C 2/20 52/309.9
2019/0330838 A1 * 10/2019 Bowron ..... E04B 1/3483

* cited by examiner

*Primary Examiner* — Brian E Glessner
*Assistant Examiner* — Adam G Barlow
(74) *Attorney, Agent, or Firm* — Invenstone Patent, LLC

(57) ABSTRACT

The present disclosure provides a Tetris house in which a structural material and an insulating material are combined with each other to further save a space, and an exterior of the structural material is treated with neoprene to block a heat bridge between an inside and an outside and prevent condensation. The Tetris house includes a plurality of structural materials which are installed in regions corresponding to respective sides of a hexahedron, and a connector which is installed in a region corresponding to each corner of the hexahedron to connect adjacent structural materials to each other, in which the structural material includes a metal pipe, a first insulating material with which an inside of the metal pile is filled, and a second insulating material which surrounds an outside of the metal pipe.

7 Claims, 30 Drawing Sheets

TETRIS HOUSE

BACKGROUND OF THE DISCLOSURE

Field of the Disclosure

The present disclosure relates to a Tetris house.

Related Art

A form of residence in modern cities is increasingly dense, and in recent years, the form of residence has been changed in various ways. As one of the various ways, there is a narrow house. The biggest feature of the narrow houses is a narrow land area where a construction program required for a user is difficult to be constituted horizontally. Currently, various method of constructing the narrow house are divided into two methods, that is, a vertically stacked method and a skip floor method.

Meanwhile, in recent years, a Tetris house has been researched and constructed, in which a module is divided into smaller modules in a small area and various program types are achieved through a combination of the modules. For example, the modules are combined horizontally and vertically, and thus, the modules create various space shapes and configurations as blocks of a Tetris game. Moreover, the most efficient assembly method is implemented according to a relationship and shape between the blocks. This method is emerging as an alternative that can be applied not only to a detached house but also to an apartment house.

The above-described information disclosed in a technology that is a background of the invention is only for improving the understanding of the background of the present disclosure, and thus may include information which does not constitute the prior art.

SUMMARY OF THE DISCLOSURE

The present disclosure provides a Tetris house. The present disclosure also provides a Tetris house in which a structural material and an insulating material are combined with each other to further save a space. The present disclosure also provides a Tetris house in which an exterior of the structural material is treated with neoprene to block a heat bridge between an inside and an outside and prevent condensation.

In an aspect, there is provided a Tetris house including: a plurality of structural materials which are installed in regions corresponding to respective sides of a hexahedron; and a connector which is installed in a region corresponding to each corner of the hexahedron to connect adjacent structural materials to each other, in which the structural material includes a metal pipe, a first insulating material with which an inside of the metal pile is filled, and a second insulating material which surrounds an outside of the metal pipe.

Accordingly, in the present disclosure, both the inside and the outside of the structural material are treated with the insulating materials. Therefore, a heat bridge between the inside and outside is prevented, and the Tetris house having excellent insulating performance is provided.

The connector may include three to six openings to which the structural material is coupled, and an angle between the openings adjacent to each other may be 90° or 180°.

Accordingly, in the present disclosure, the connectors having a variety number are provided, and thus, thus, the Tetris houses having a hexahedral shape can be coupled to each other to have a variety of designs.

The connector includes a metal pipe, a first insulating material with which an inside of the metal pipe is filled, and a second insulating material which surrounds an outside of the metal pipe.

Accordingly, in the present disclosure, both the inside and the outside of the connector are treated with the insulating materials. Therefore, a heat bridge between the inside and outside is prevented, and the Tetris house having excellent insulating performance is provided.

The metal pipe may include steel, the first insulating material may include an urethan foam, and the second material may include neoprene.

Accordingly, the present disclosure provides the Tetris house having excellent strength, excellent seismic performance, and excellent insulation performance.

The second insulating material may be finished with a zipper.

Accordingly, in the present disclosure, it is possible to easily perform the external insulation treatment of the structural material.

The zipper may be covered with a protective tape.

Accordingly, the present disclosure prevents the zipper from being corroded or damaged from an external environment.

The structural material and the connector are coupled to each other by a bolt and a nut.

Accordingly, in the present disclosure, the structural material and the connector are strongly coupled with each other and fixed to each other.

The blot and the nut may be covered with the second insulating material.

Accordingly, in the present disclosure, the blot and the nut are also prevented from being corroded or damaged from the external environment.

A plastic H beam is coupled between the structural materials facing each other.

Accordingly, in the present disclosure, a plurality of light H beams are coupled between the structural materials facing each other, and thus, it is possible to provide the Tetris house having more excellent strength and seismic performance.

DESCRIPTION OF EXEMPLARY EMBODIMENTS

Figure 1A:
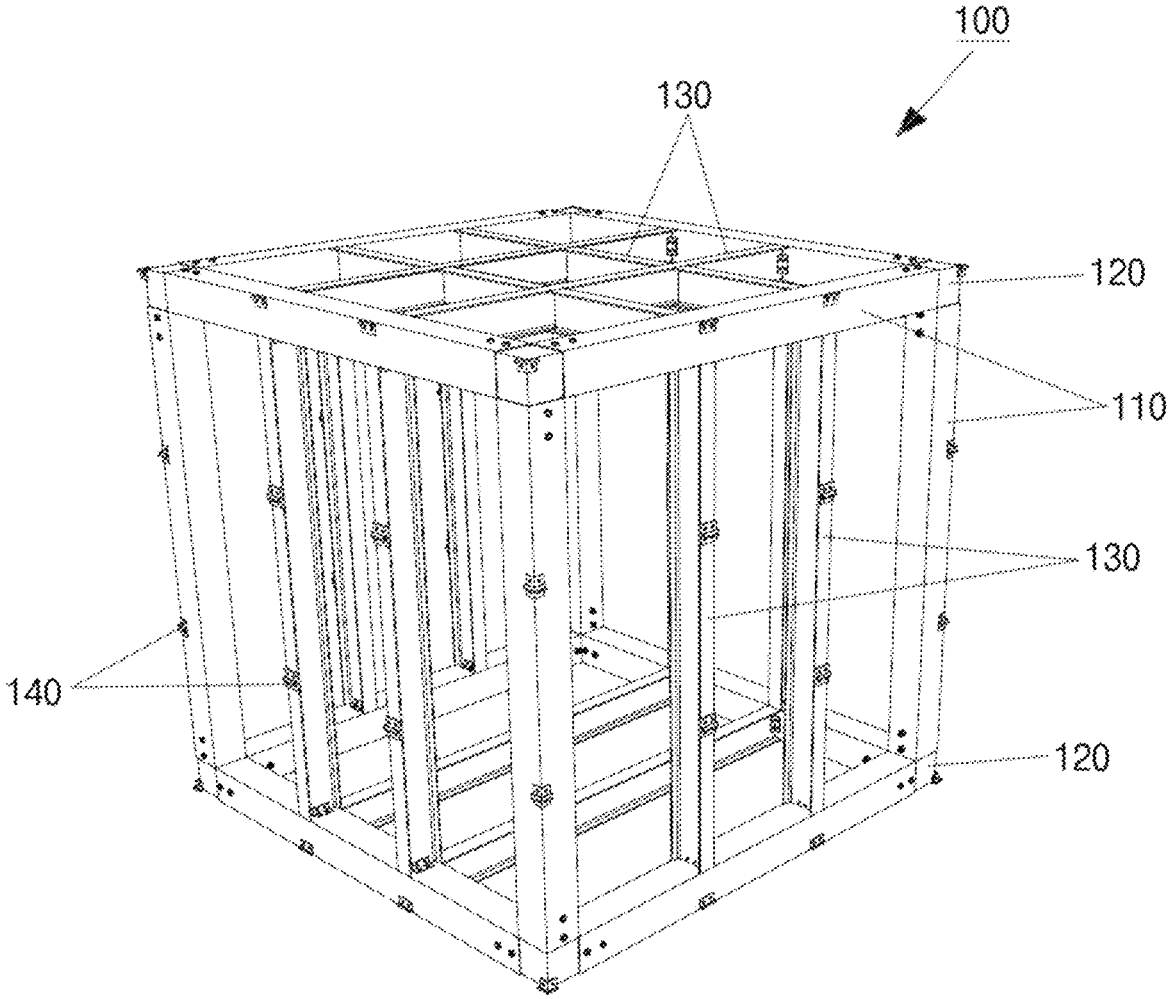
FIGS. 1A and 1B are perspective views illustrating a Tetris house according to the present disclosure.

Hereinafter, preferred embodiments of the present disclosure will be described in detail with reference to the accompanying drawings.

The embodiments of the present disclosure are provided to more fully explain the present disclosure to a person skilled in the art, the following embodiments may be modified in various other forms, and a scope of the present disclosure is not limited to the embodiments below. These embodiments are provided to make the present disclosure more faithful and complete, and to fully convey an idea of present disclosure to a person skilled in the art.

In addition, in the following drawings, a thickness or a size of each layer is exaggerated for convenience and clarity of explanation, and the same reference numerals in the drawings refer to the same elements. As used herein, a term "and/or" includes any one of listed items and all combinations of one or more of the listed items. In addition, in the present specification, "connection" means not only when an A member and a B member are directly connected, but also when a C member is interposed between the A member and the B member to indirectly connect the A member and the B member.

A terminology used herein is used to describe a specific embodiment, and is not intended to limit the present disclosure. As used herein, a singular form may include a plural form unless the context clearly indicates otherwise. Moreover, as used herein, "comprise, include" and/or "comprising, including" refer to specify presences of referred shapes, numbers, steps, actions, members, elements, and/or groups thereof, and does not exclude the presences or additions of one or more other shapes, numbers, actions, members, elements, and/or groups.

In the present specification, although terms such as first and second are used to describe various members, parts, regions, layers, and/or portions. However, it is obvious that these members, parts, regions, layers, and/or portions should not be limited by these terms. These terms are only used to distinguish one member, part, region, layer, or portion from other members, parts, regions, layers, or portions. Accordingly, the first member, part, region, layer, or portion described below may refer to a second member, part, region, layer, or portion without departing from the teachings of present disclosure.

Terms related to space such as "beneath", "below", "lower", "above", and "upper" may be used so that one element or feature illustrated in the drawings is easily understood from other elements or features. The terms related to these spaces are for easy understanding of the present disclosure according to various process conditions or use conditions of the present disclosure, and are not intended to limit the present disclosure. For example, if an element or feature in the drawing is inverted, the element or feature described as "bottom" or "below" will be described as "top" or "above". Accordingly, "below" is a concept including "top" or "bottom".

Figure 1B:
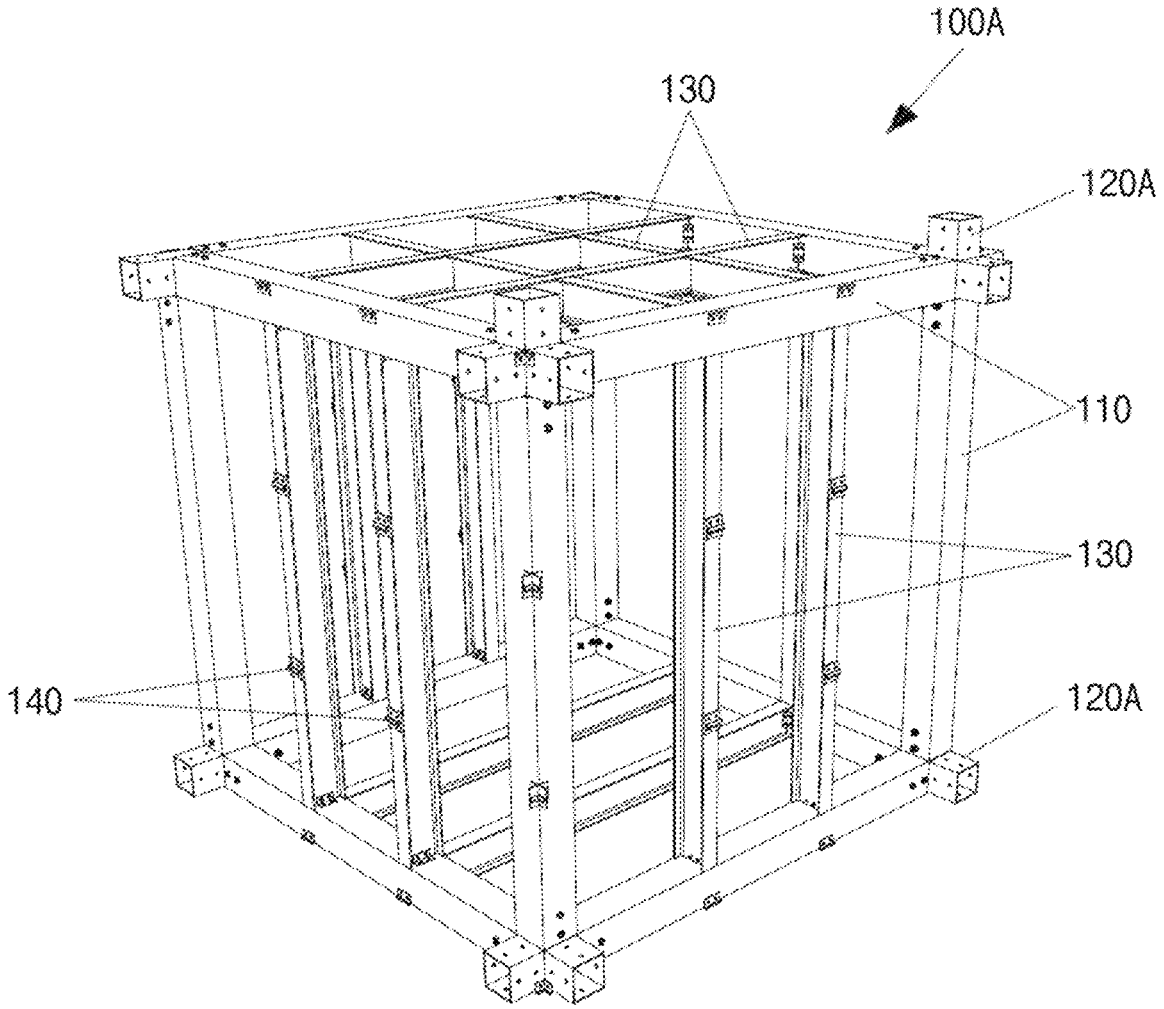

FIGS. 1A and 1B are perspective views illustrating Tetris houses 100 and 100A according to the present disclosure.

As illustrated in FIGS. 1A and 1B, the Tetris houses 100 and 100A may include a plurality of structural materials 110, a plurality of connectors 120 and 120A, and a plurality of H beams 130. Moreover, the Tetris house 100 and 100A according to an embodiment of the present disclosure may further include a plurality of exterior fixing materials 140.

The plurality of structural materials 110 may be installed in regions corresponding to respective sides of an approximate hexahedron. Accordingly, for example, approximately 12 structural materials 110 may be provided.

For example, the structural material 110 may include a metal pipe 110*a* (refer to FIG. 2), a first insulating material 111 (refer to FIG. 9B) with which an inside of the metal pipe 110*a* is filled, and a second insulating material 112 (refer to FIG. 9B) which surrounds an outside of the metal pipe 110*a*. This will be explained again below.

In addition, a length of the structural material 110 may be approximately 3m, which is a value derived from the most preferable numerical value in stiffness and seismic design.

The plurality of connectors 120 are installed in regions corresponding to respective corners of an approximate hexahedron, and may connect adjacent structural materials 110 to each other. Accordingly, for example, approximately eight connectors 120 and 120A may be provided.

For example, each of the connectors 120 and 120A may include a metal pipe 120*a* (refer to FIG. 3A), a first insulating material 121 (refer to FIG. 9B) with which an inside of the metal pipe 120*a* is filled, and a second insulating material 122 (refer to FIG. 9B) which surrounds an outside of the metal pipe 121. This will be explained again below.

The plurality of H beams 130 are installed between the structural materials 110 facing each other, and can connect the structural materials 110 facing each other. For example, the plurality of H beams 130 may be respectively provided between an upper region, a lower region, and four side regions provided between the upper and lower regions of each of the Tetris houses 100 and 100A. For example, the H beam 130 may include a plastic (for example, polycarbonate) body and a second insulating material (for example, neoprene) surrounding the plastic body.

Meanwhile, the exterior fixing material 140 may be variously attached to an outer surface, an inner surface, and/or a side surface therebetween of the structural material 110, the connectors 120 and 120A, and/or the H beam 130. The exterior fixing materials 140 couple the plurality of Tetris houses 100 and 100A to each other, couple various structures such as a window, a door, and/or a wall to one Tetris house 100 or 100A, or reinforce rigidity and seismic performance of one Tetris house 100 or 100A.

As described above, a hollow hexahedral structure, that is, the Tetris houses 100 and 100A, may be completed by the plurality of structural materials 110, the plurality of connectors 120 and 120A, and the plurality of H beams 130, and the plurality of Tetris houses 100 and 100A are coupled to each other to complete a house.

In particular, in the embodiment of the present disclosure, the structural material 110 and the insulating material are coupled to each other, and thus, it is possible to provide the Tetris house 100,100A that can further save a space. For example, an inside of the structural material 110 is treated with a first insulating material 111 and an outside of the structural material 110 is treated with a second insulating material 112. Accordingly, is possible to provide the Tetris houses 100 and 100A in which the heat bridge between the inside and the outside of the structural material 110 is prevent, and thus, condensation is prevented.

Figure 2:
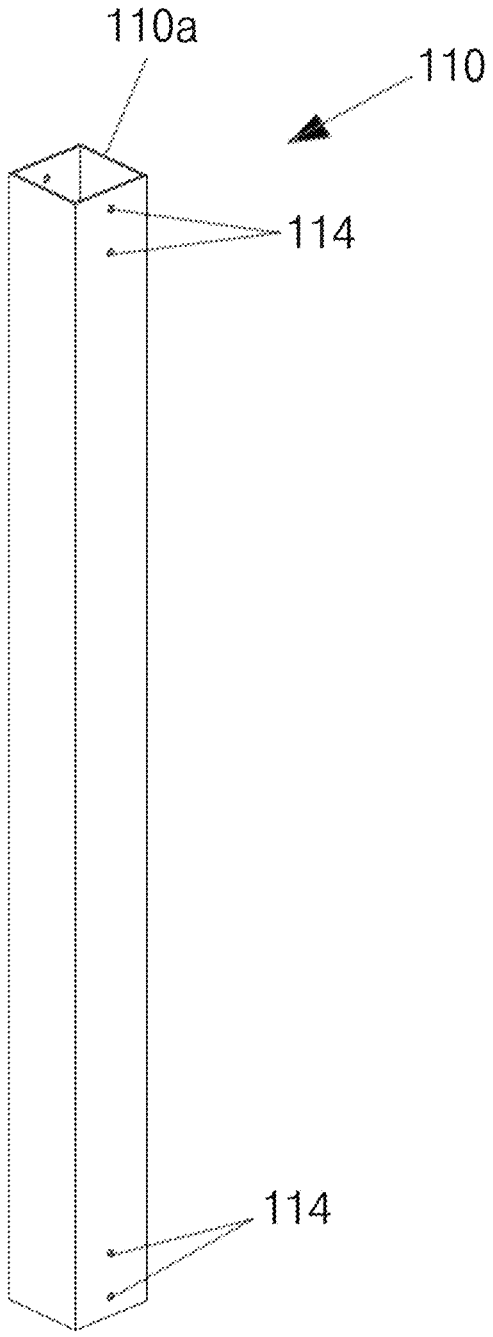
FIG. 2 is a perspective view illustrating a structural material in the Tetris house according to the present disclosure.

FIG. 2 is a perspective view illustrating the structural material 110 in the Tetris houses 100 and 100A according to the present disclosure.

As illustrated in FIG. 2, the structural material 110 in each of the Tetris houses 100 and 100A may be in the form of a square or rectangular pipe having a length of approximately 3m. In particular, the structural material 110 may be formed of the metal pipe 110*a*, and for example, the metal pipe 110*a* may be formed of steel, steel alloy, aluminum, aluminum alloy, or the like. Of course, the inside of the metal pipe 110*a* may filled with the first insulating material 111 (refer to FIG. 9B), and the outside of the metal pipe 110*a* may be finished with the second insulating material 112 (refer to FIG. 9B). In addition, upper and lower ends of the metal pipe 110*a* may include a plurality of through holes 114 formed to be connected to the connectors 120 and 120A.

FIGS. 3A, 3B, 4A, 4B, 5A, 5B, 6A, and 6B are perspective views illustrating the connectors 120 to 120D in the Tetris houses 100A and 100B according to the present disclosure.

Commonly, in the Tetris houses 100 and 100A, the connectors 120 to 120D may have a square or rectangular pipe shape bent at an angle of approximately 90° or 180° to each other. In particular, the connector 120 may be formed of a metal pipe 120*a*, and for example, the metal pipe 120*a* may be formed of, steel, steel alloy, aluminum, aluminum alloy, or the like. Of course, an inside of the metal pipe 120*a* may be filled with a first insulating material 121 (refer to FIG. 9B), and an outside of the metal pipe 120*a* may be treated with a second insulating material 122 (refer to FIG. 9B). In addition, the metal pipe 120*a* may include an opening 120*b* which is formed to be connected to the structural material 110 at each end, and a plurality of through holes 123 which formed to be coupled to the structural material 110.

Figure 3A:
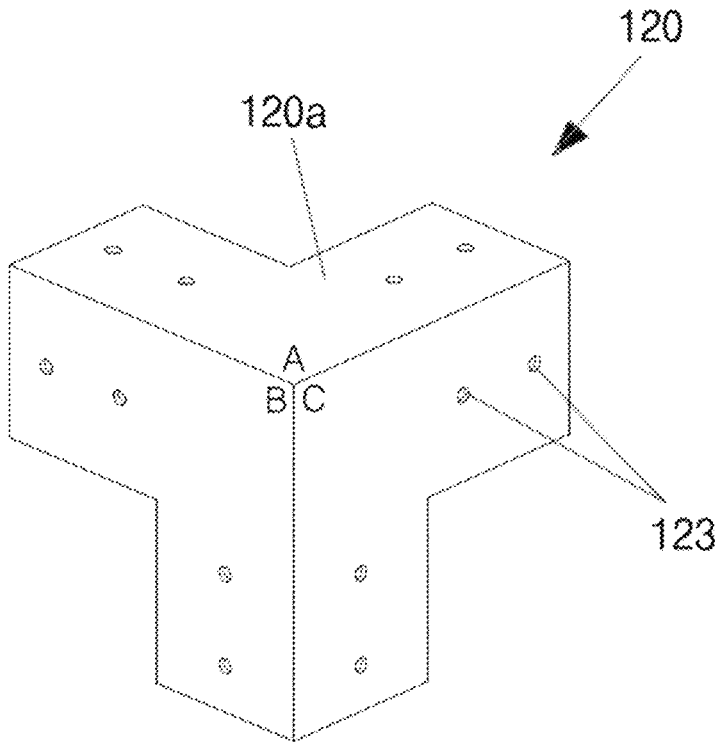
FIGS. 3A, 3B, 4A, 4B, 5A, 5B, 6A, and 6B are perspective views illustrating a connector in the Tetris house according to the present disclosure.
Figure 3B:
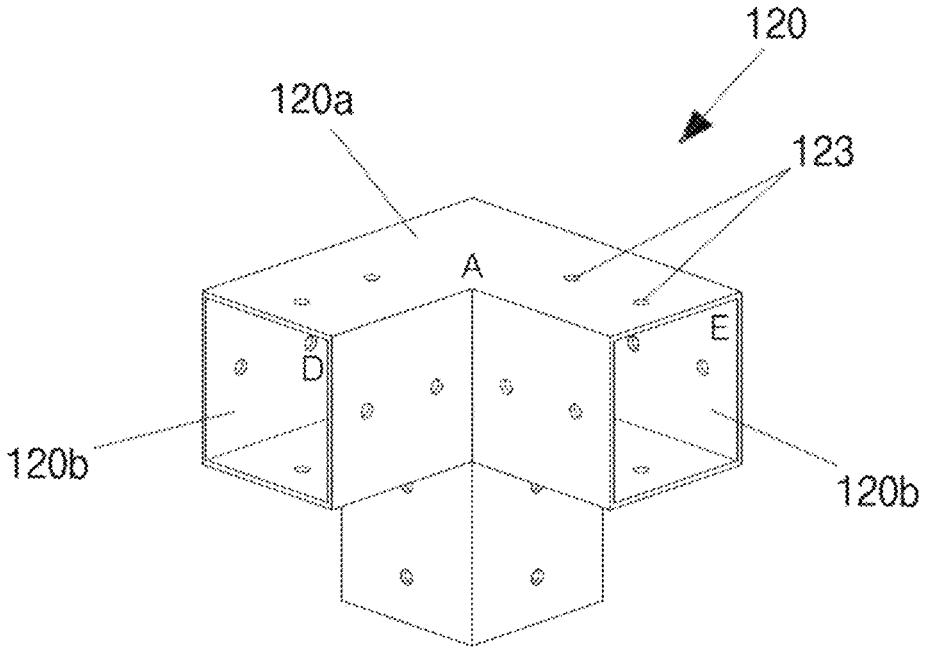

As illustrated in FIGS. 3A and 3B, the connector 120 of each of the Tetris houses 100 and 100A may include three openings 120*b*, and an angle between the three openings 120B may have an angle of 90°. In this way, three structural materials 110 may be coupled to one connector 120, and the structural materials 110 may each form an angle of 90°.

Figure 4A:
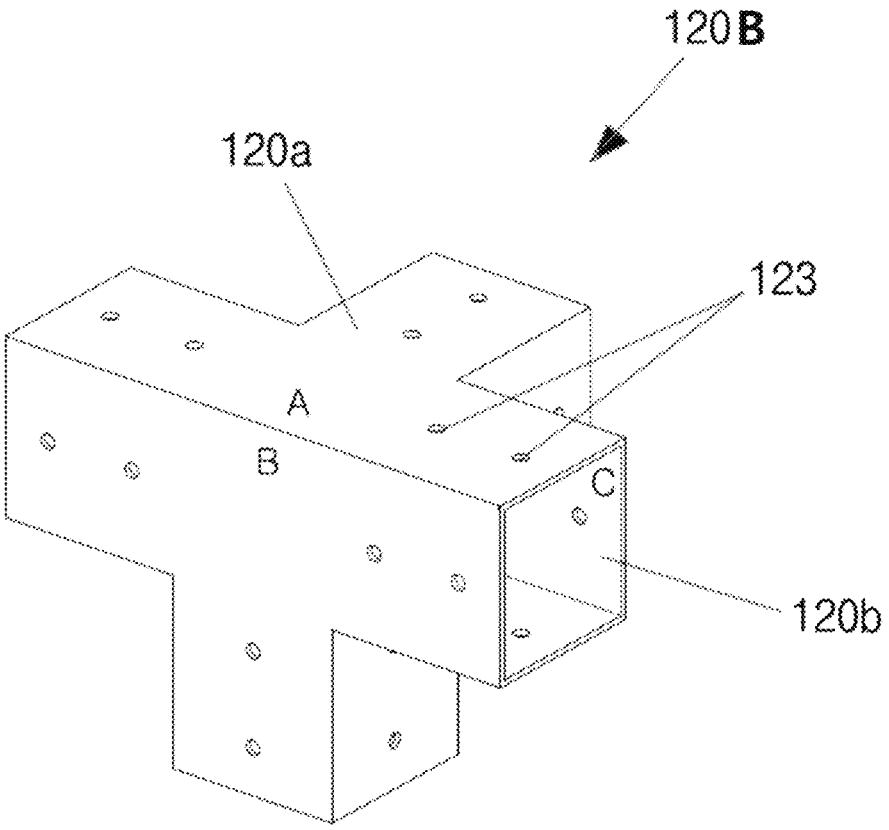
Figure 4B:
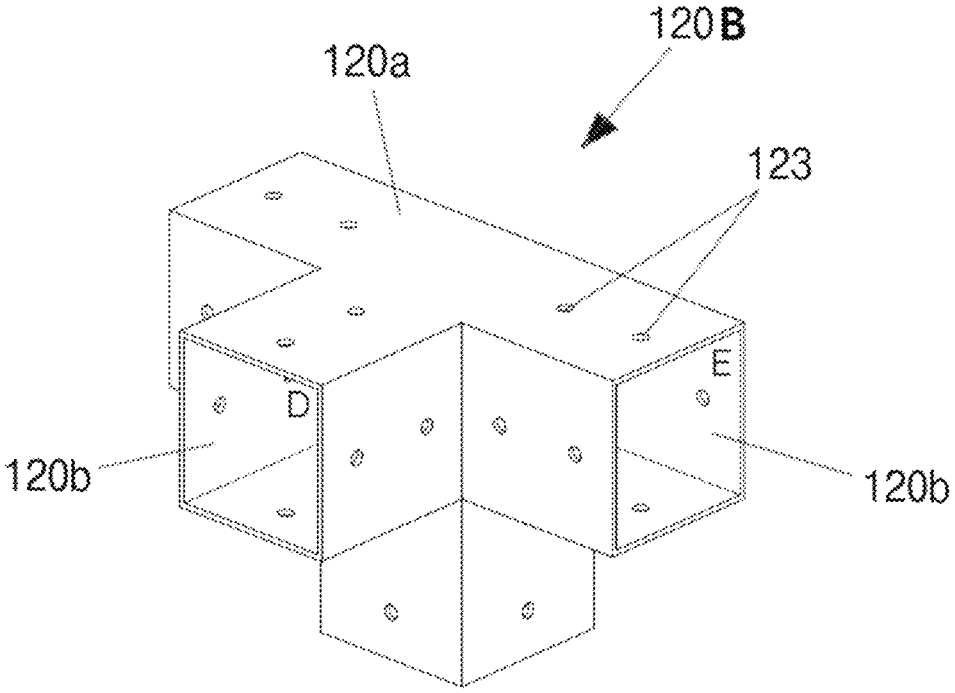

As illustrated in FIGS. 4A and 4B, the connector 120B in each of the Tetris houses 100 and 100A may include four openings 120*b*, and an angle between the four openings 120B may be 90° or 180°. In this way, four structural materials 110 may be coupled to one connector 120B, and the structural materials 110 may each form an angle of 90° or 180°.

Figure 5A:
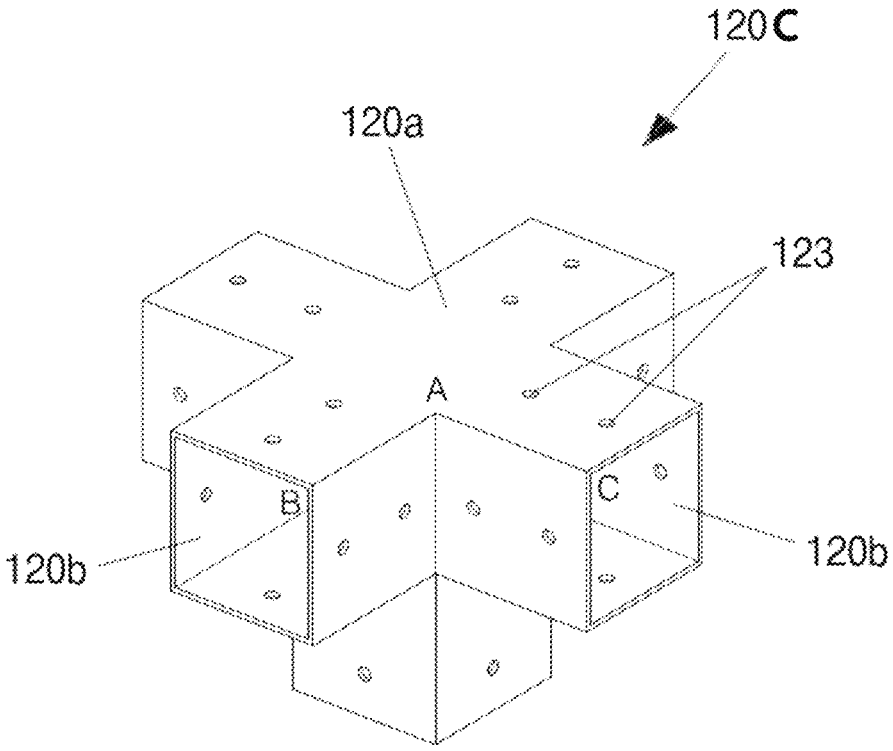
Figure 5B:
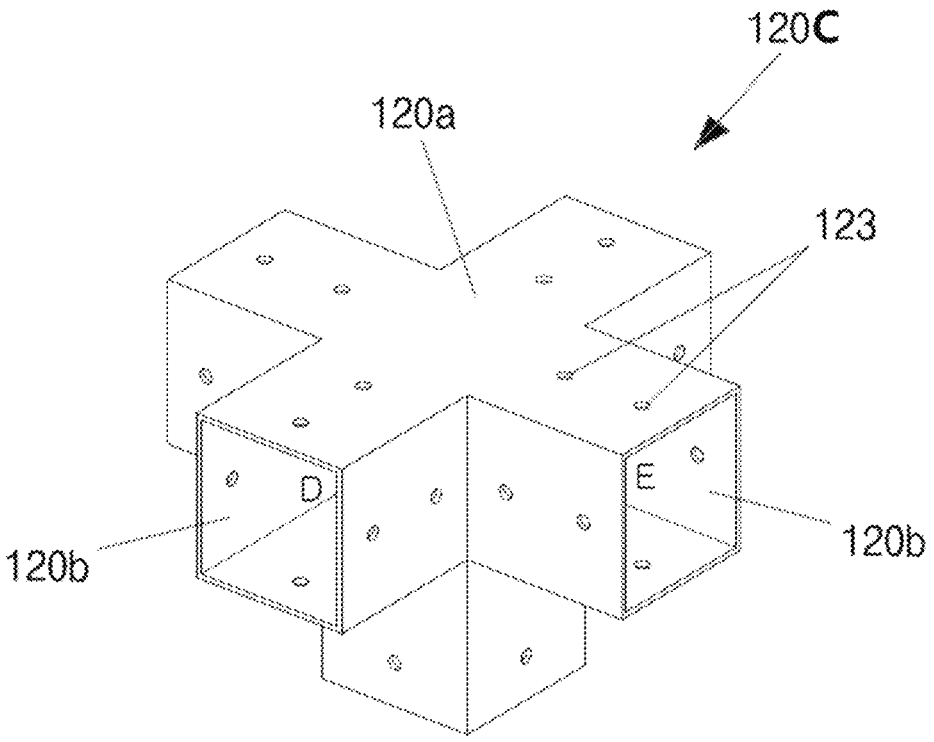

As illustrated in FIGS. 5A and 5B, the connector 120C in each of the Tetris houses 100 and 100A may include five openings 120*c*, and an angle between the five openings 120C may be 90° or 180°. In this way, five structural materials 110 may be coupled to one connector 120C, and the structural materials 110 may each form an angle of 90° or 180°.

Figure 6A:
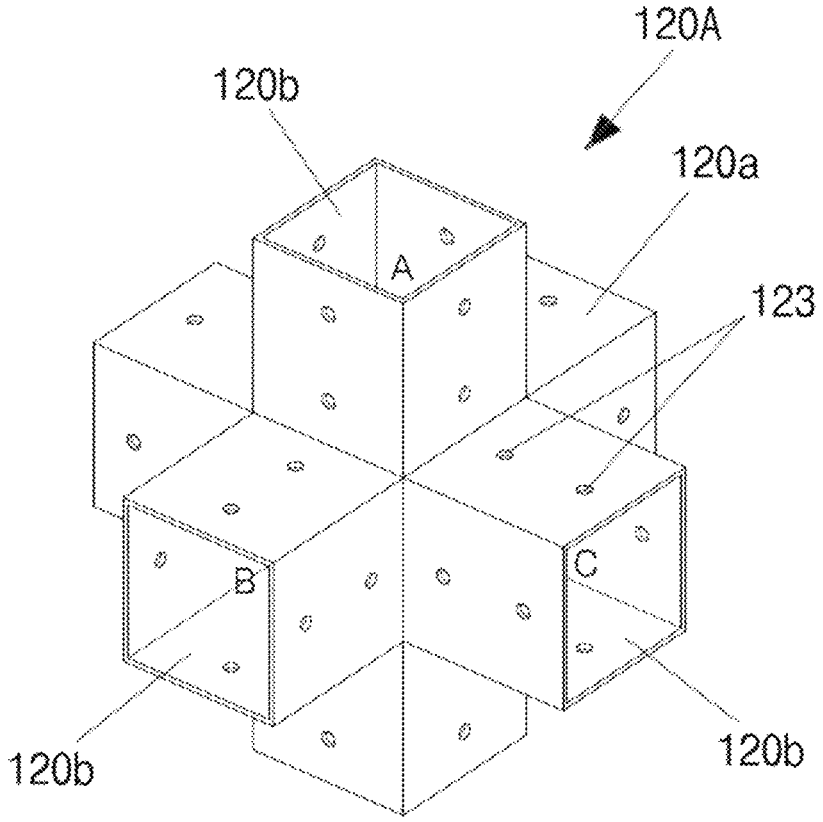
Figure 6B:
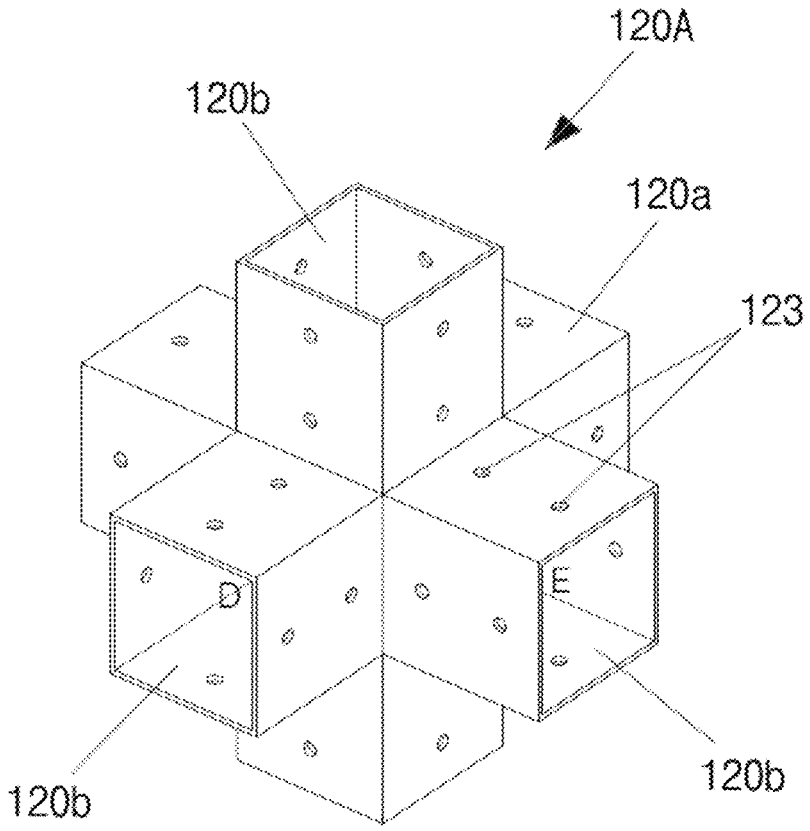

As illustrated in FIGS. 6A and 6B, the connector 120A in each of the Tetris houses 100 and 100A may include six openings 120*b*, and an angle between the six openings 120A may be 90° or 180°. In this way, six structural materials 110 may be coupled to one connector 120A, and the structural materials 110 may each form an angle of 90° or 180°.

In this way, in the Tetris houses 100 and 100A according to the embodiment of the present disclosure, the connectors 120 to 120D including the openings 120*b* having a variety of numbers are provided, and thus, the Tetris house having a variety of designs can be implemented. That is, the connectors 120 to 120D are appropriately selected and used according to the number or design of the Tetris houses to be coupled to each other, and thus, a user can easily design a house having a desired design.

Figure 7A:
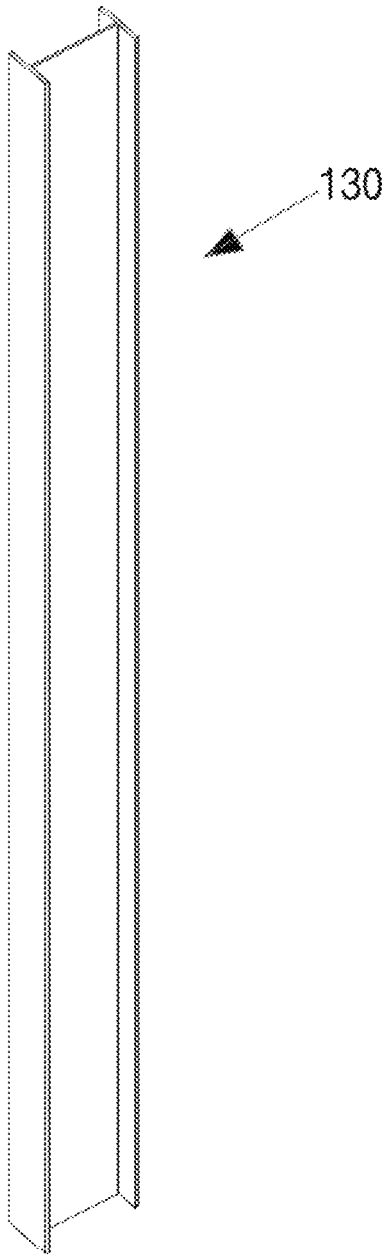
FIGS. 7A to 7C are perspective views illustrating an H beam in the Tetris house according to the present disclosure.
Figure 7B:
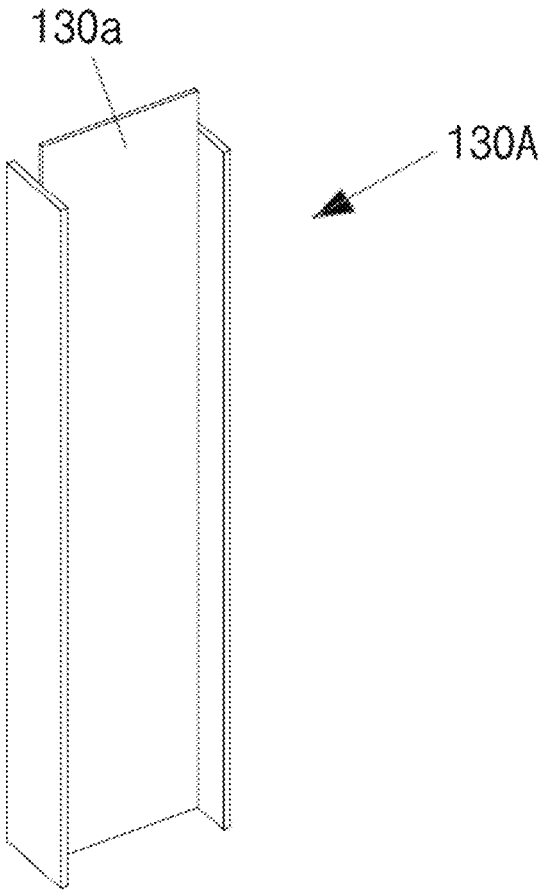
Figure 7C:
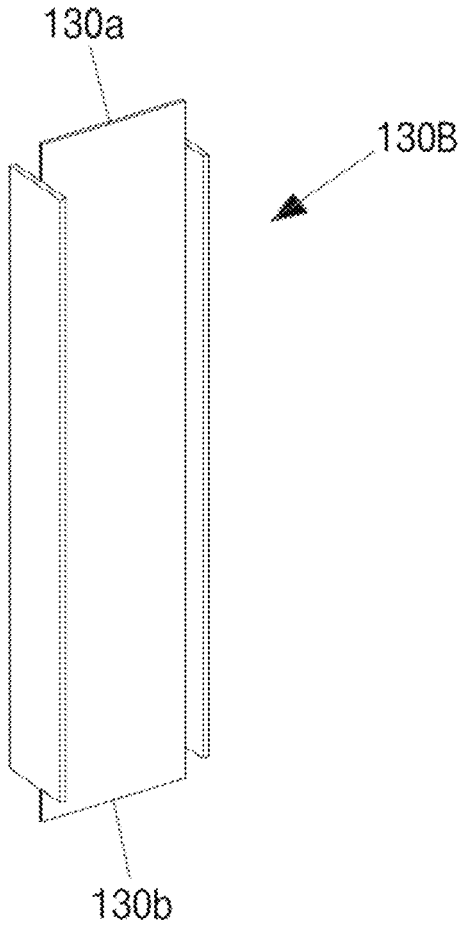
Figure 8A:
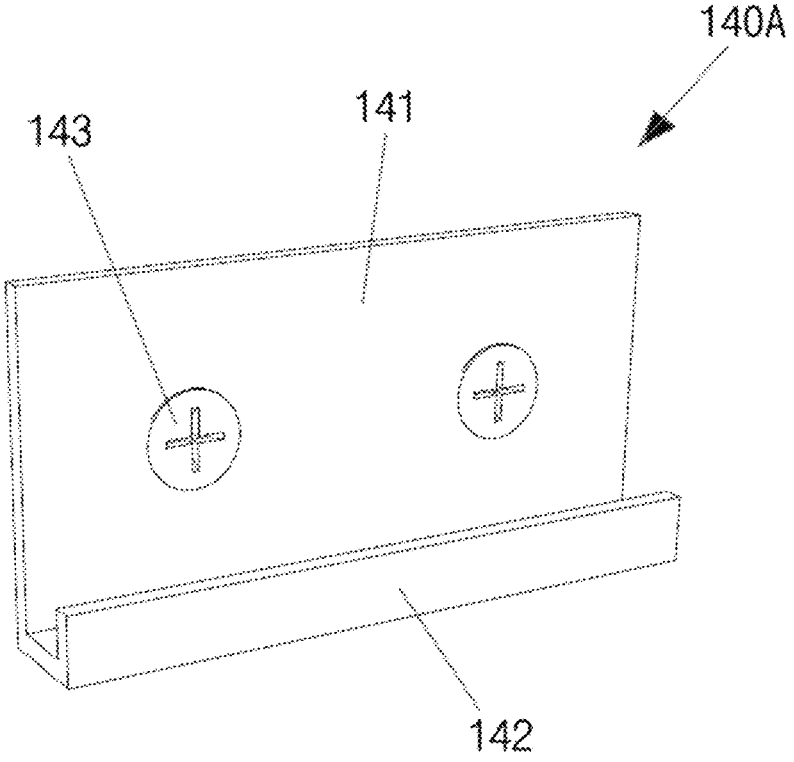
FIGS. 8A to 8G are perspective views illustrating an exterior fixing material in the Tetris house according to the present disclosure.
Figure 8B:
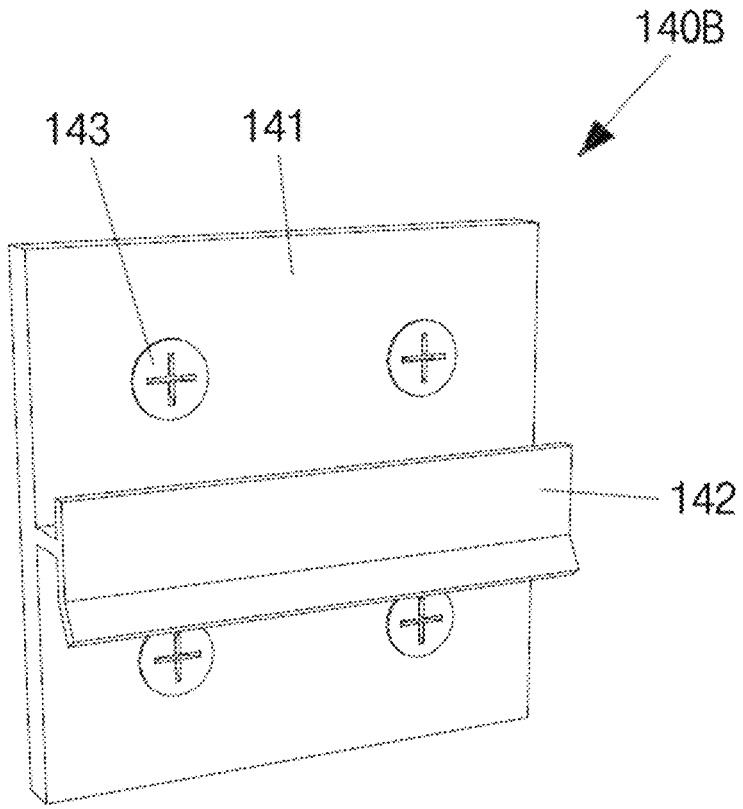
Figure 8C:
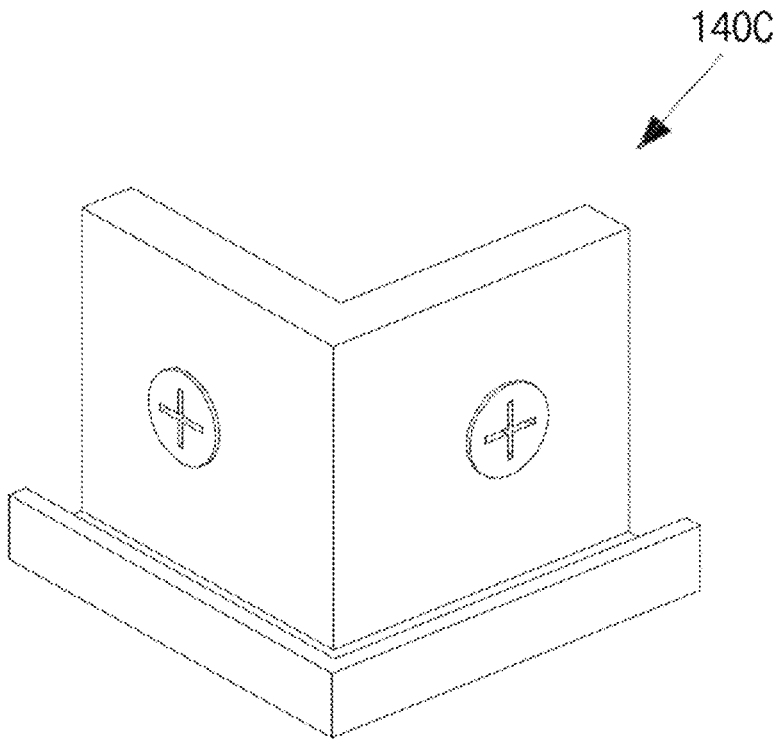
Figure 8D:
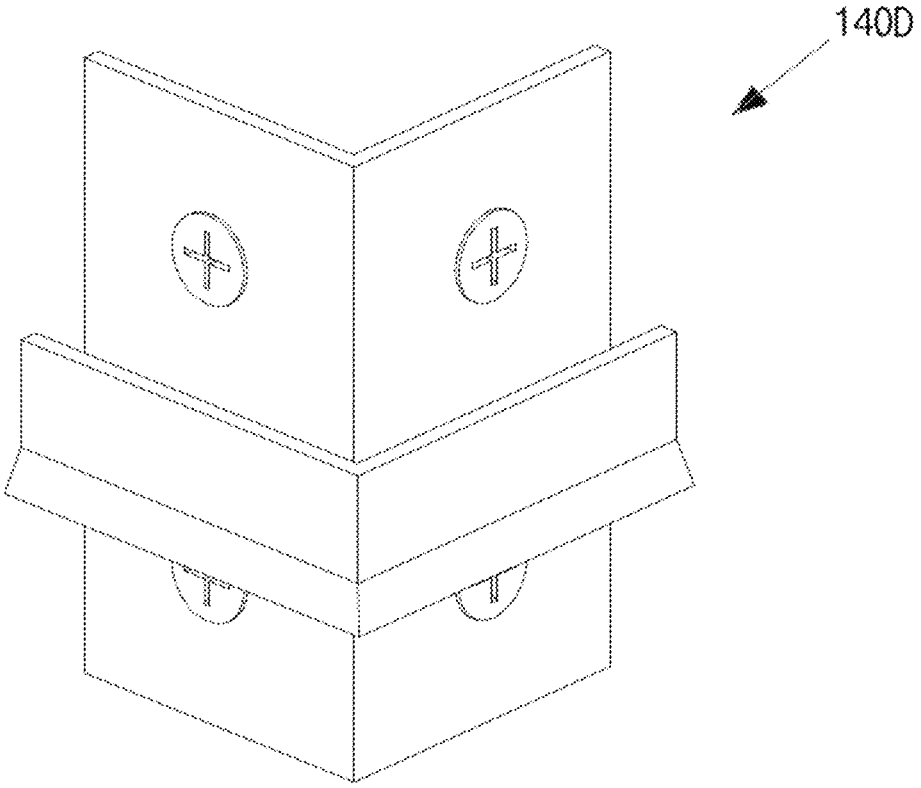
Figure 8E:
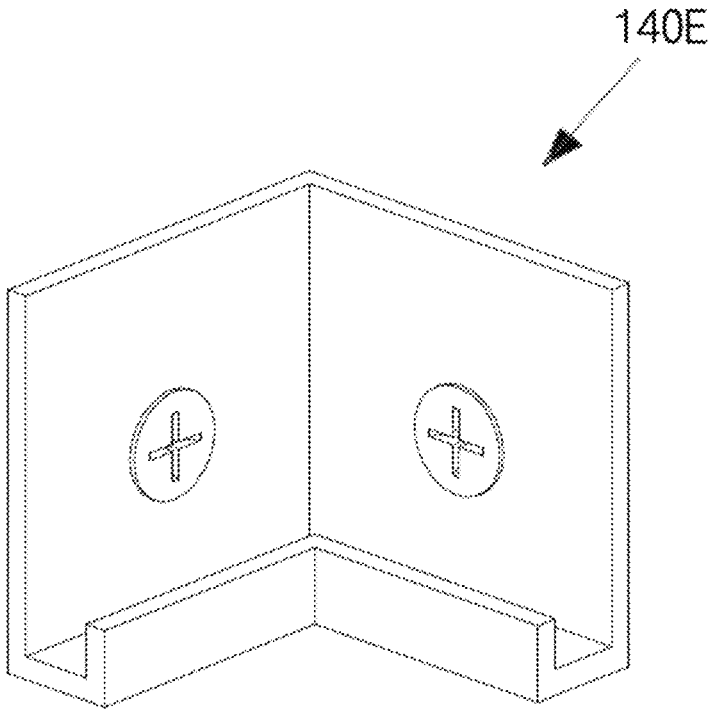
Figure 8F:
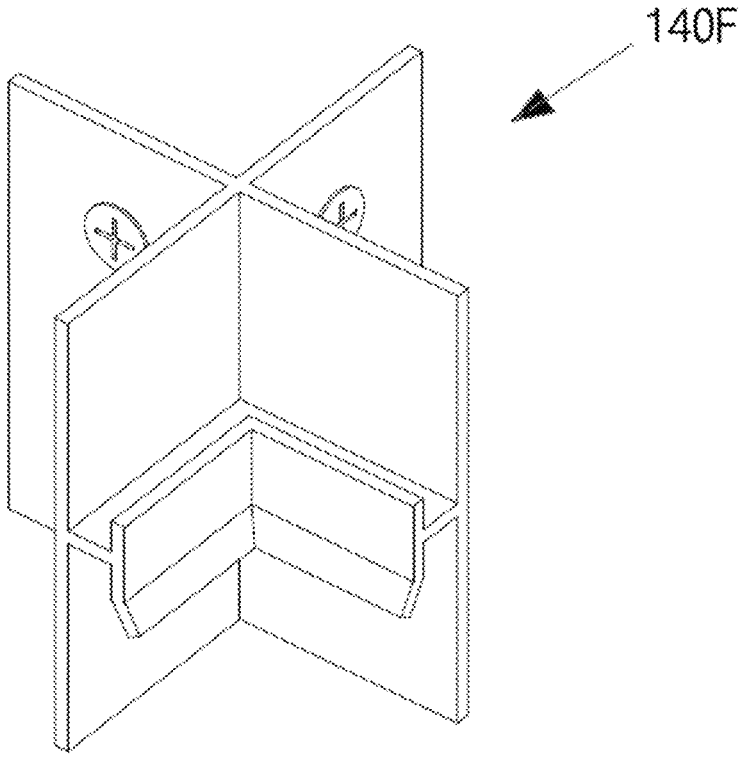
Figure 8G:
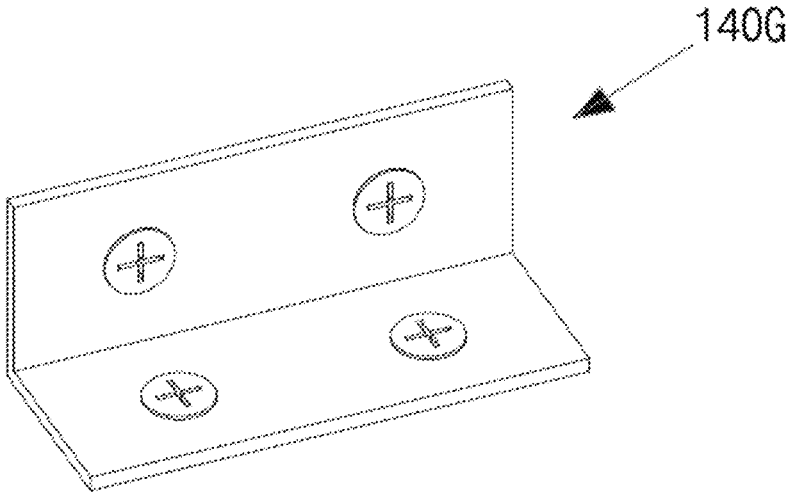

FIGS. 7A to 7C are perspective views illustrating H beams 130, 130A, 130B in each of the Tetris houses 100 and 100A according to the present disclosure.

As illustrated in FIGS. 7A to 7C, the H beams 130, 130A, and 130B of the Tetris houses 100 and 100A may be formed of a substantially H-shaped polycarbonate material and may be finish with a second insulating material (for example, neoprene).

In particular, as illustrated in FIGS. 7B and 7C, the H beams 130A and 130B may have protrusions 130*a* and 130*b* formed on an upper end, or the upper end and a lower end thereof, respectively. Therefore, the H beams 130A and 130B can be easily coupled to the structural material 110 through the protrusions 130*a* and 130*b*.

FIGS. 8A to 8G are perspective views illustrating exterior fixing material in the Tetris houses 100 and 100A according to the present disclosure.

As illustrated in FIGS. 8*a* to 8*g*, each of exterior fixing materials 140A to 140G in each of the Tetris houses 100 and 100A may include a fixed plate 141 which is fixed to the structural material 110, the connector 120, and/or the H beam 130 through a bolt 143, and a bent plate 142 which is bent outwardly and extended from the fixed plate 141. The fixed plate 141 and the bent plate 142 may be formed in various forms according to the shapes of the structural material 110, the connector 120, and/or the H beam 130.

The exterior fixing materials 140A to 140G are fixed to the structural material (110), the connector 120, and/or the H beam 130, and thus, the approximately hexahedral Tetris houses 100 and 100A can be assembled in various forms. Accordingly, the exterior fixing material 140 may be fixed in various shapes at various positions according to the shapes of the designed Tetris houses 100 and 100A.

Moreover, the exterior fixing materials 140A to 140G are fixed at various positions of the structural material 110, the connector 120 and/or the H beam 130, and thus, a structure such as a window, a door and/or a wall can be easily fixed.

Figure 9A:
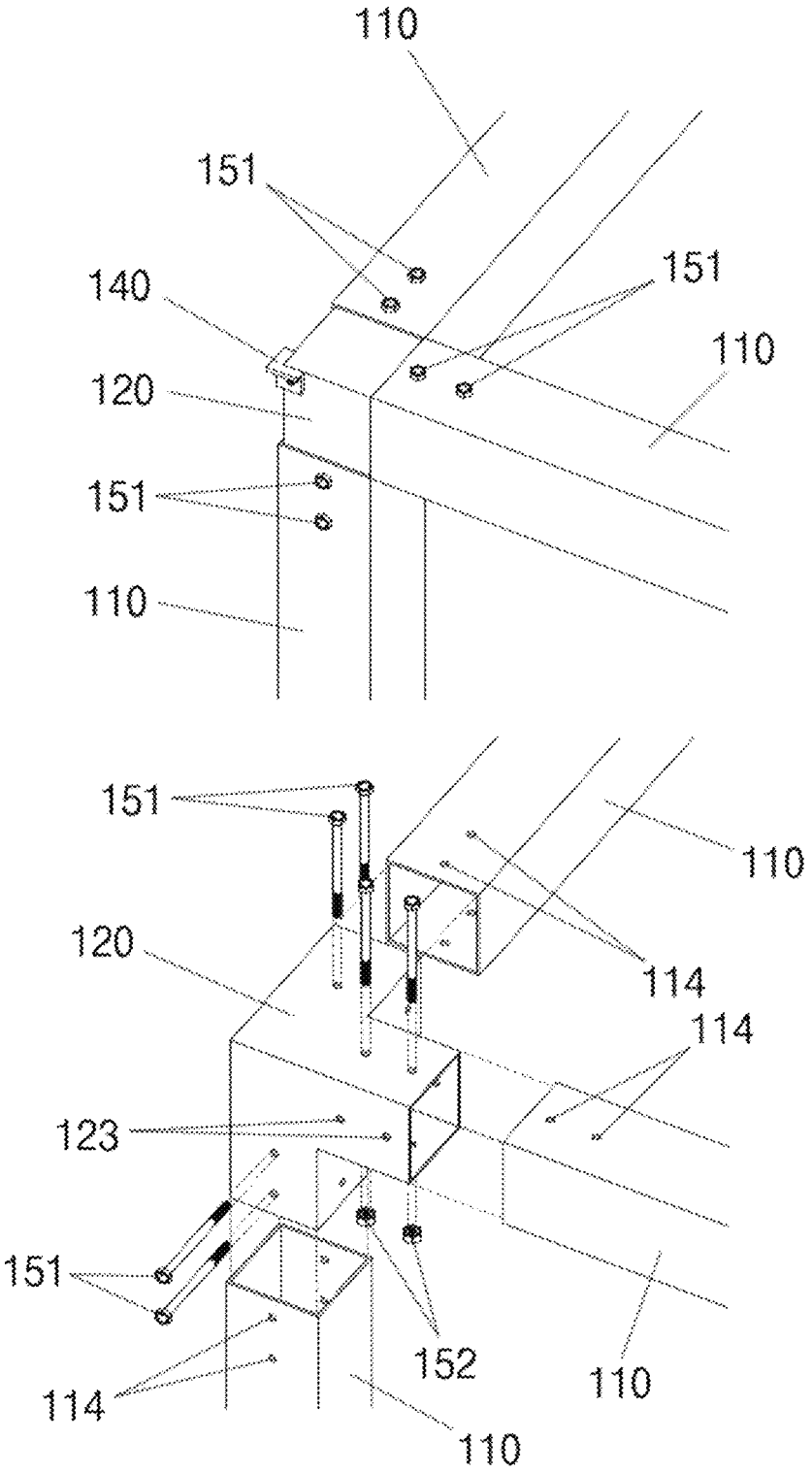
FIGS. 9A and 9B are a partially exploded perspective view and a partially cross-sectional view in the Tetris house according to the present disclosure.
Figure 9B:
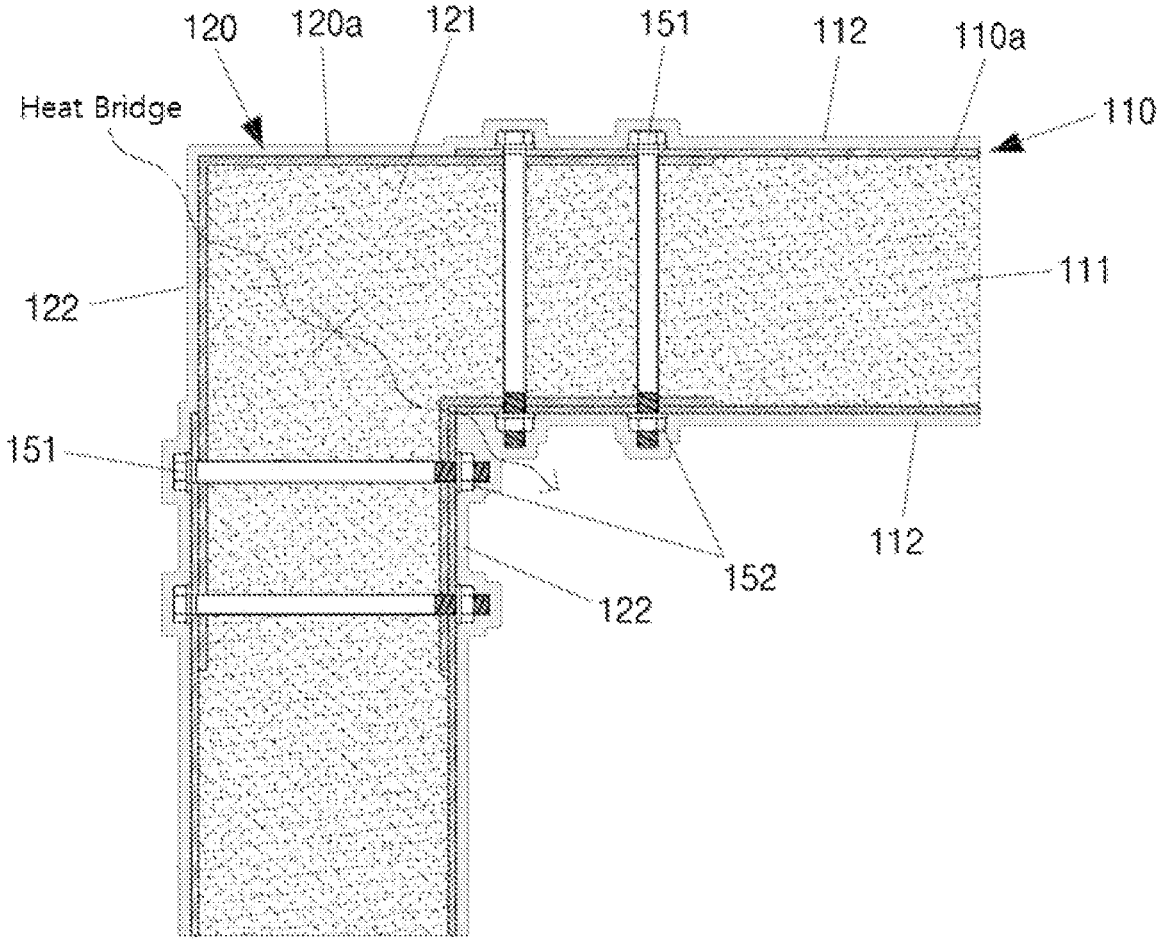

FIGS. 9A and 9B are a partially exploded perspective view and a partially cross-sectional view in each of the Tetris houses 100 and 100A according to the present disclosure.

As illustrated in FIGS. 9A and 9B, in each of the Tetris houses 100 and 100A, after the structural materials 110 are coupled to the connector 120, bolts 151 pass through the through holes 114 and 123 formed in the structural material 110 and connector 120 and screwed to nuts 152, and thus, the structural materials 110 and the connector 120 can be fixed and coupled to each other.

Here, the insides of the structural material 110 and the connector 120 may be filled with the first insulating materials 111 and 121, respectively. For example, the first insulating materials 111 and 121 may include an urethan foam, but are not limited thereto.

More specifically, the first insulating materials 111 and 121 may include an inorganic insulating material such as glass wool or mineral wool, an insulating material formed by a bead method, an insulating material formed by an extrusion method, or an organic insulating material such as a water-based soft foam or a hard urethane, but are not limited thereto.

In addition, the exterior of the structural material 110, the connector 120, and the bolts 151 or nuts 152 may be finished with the second insulating materials 112 and 122. For example, the second insulating materials 112 and 122 may include neoprene, but are not limited thereto.

Here, the neoprene refers to a trade name of chloroprene rubber or a synthetic rubber obtained by polymerizing a small amount of other monomers to the chloroprene rubber.

Chloroprene is obtained by adding hydrochloric acid to vinyl acetylene obtained by polymerizing two molecules of acetylene, and the neoprene is obtained by emulsifying the chloroprene at 5° C. or 40° C.

The neoprene is excellent in chemical resistance, oil resistance, weather resistance, heat resistance, ozone resistance, and abrasion resistance, and thus, the neoprene is suitable as the second insulating materials 112 and 122 as in the present disclosure. In addition, the neoprene can be used as a sheath of a wire, a hose, a packing, a gasket, a sole, or the like. Moreover, the neoprene has strong adhesive properties, and thus, the neoprene can be used in large quantities as an adhesive.

Figure 10A:
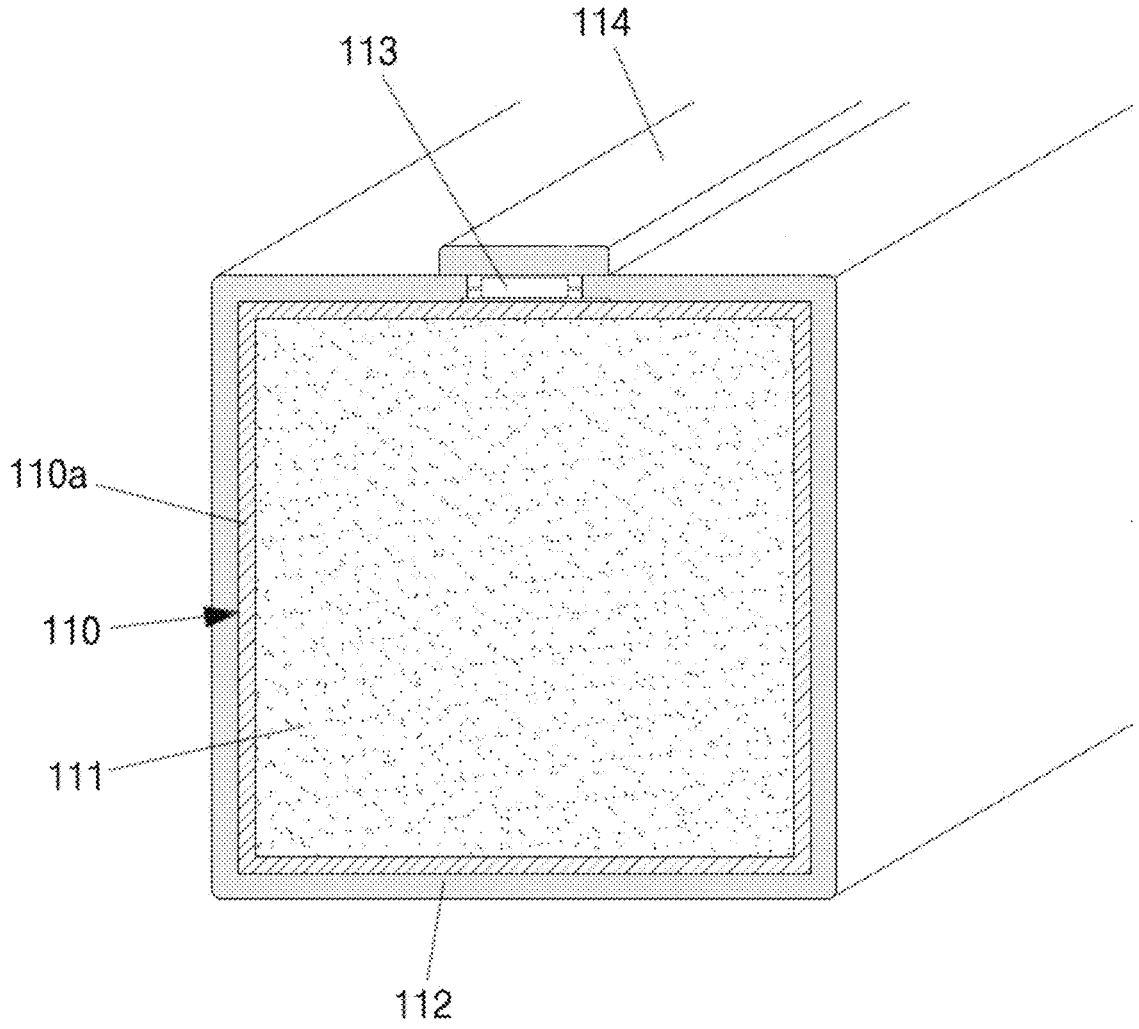
FIGS. 10A and 10B are cross-sectional views illustrating a structural material in the Tetris house according to the present disclosure.
Figure 10B:
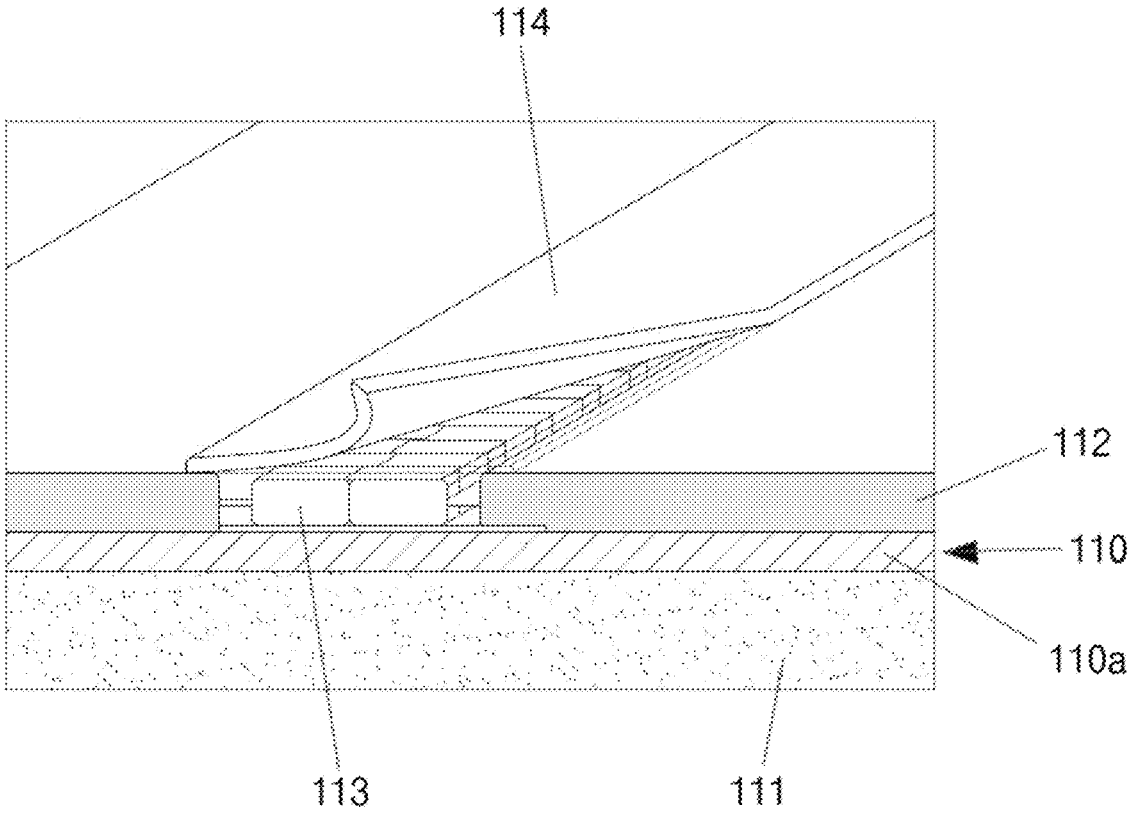

FIGS. 10A and 10B are cross-sectional views illustrating the structural material 110 in each of the Tetris houses 100 and 100A according to the present disclosure.

As illustrated in FIGS. 10A and 10B, the structural material 110 in each of the Tetris houses 100 and 100A may include the metal pipe 110*a*, the first insulating material 111 such as a urethane foam with which the inside of the metal pipe 110*a* is filled, the second insulating material 112 such as the neoprene surrounding the outside of the metal pipe 110*a*, and in particular, the second insulating material 112 may be finished by a zipper or Velcro 113. That is, the zipper or the Velcro 113 may be provided on both ends of the second insulating material 112, and the zipper or Velcro 113 are coupled to each other so that the second insulating material 112 can completely surround the structural material 110 like clothes.

Moreover, the zipper or Velcro 113 is covered with a protective tape 114, and thus, the zipper or Velcro 113 is exposed to the outside and is not damaged. For example, the protective tape 114 may be the neoprene, but not is limited thereto.

Figure 11A:
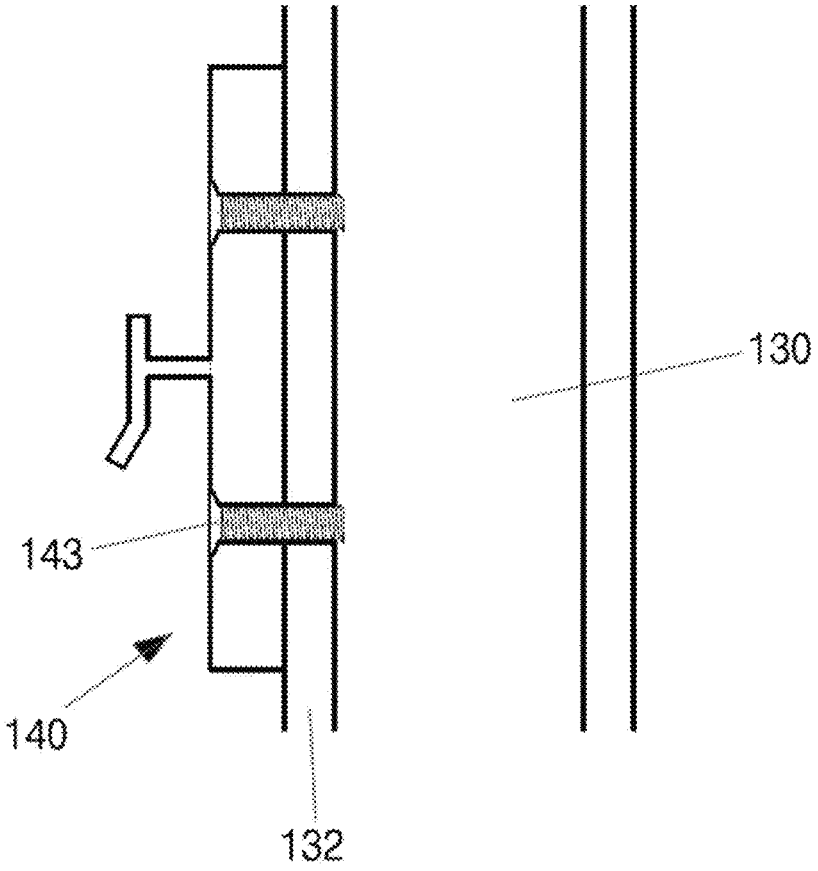
FIGS. 11A to 11C are a cross-sectional views and perspective views illustrating a state where the exterior fixing material is fixed in the Tetris house according to the present disclosure.
Figure 11B:
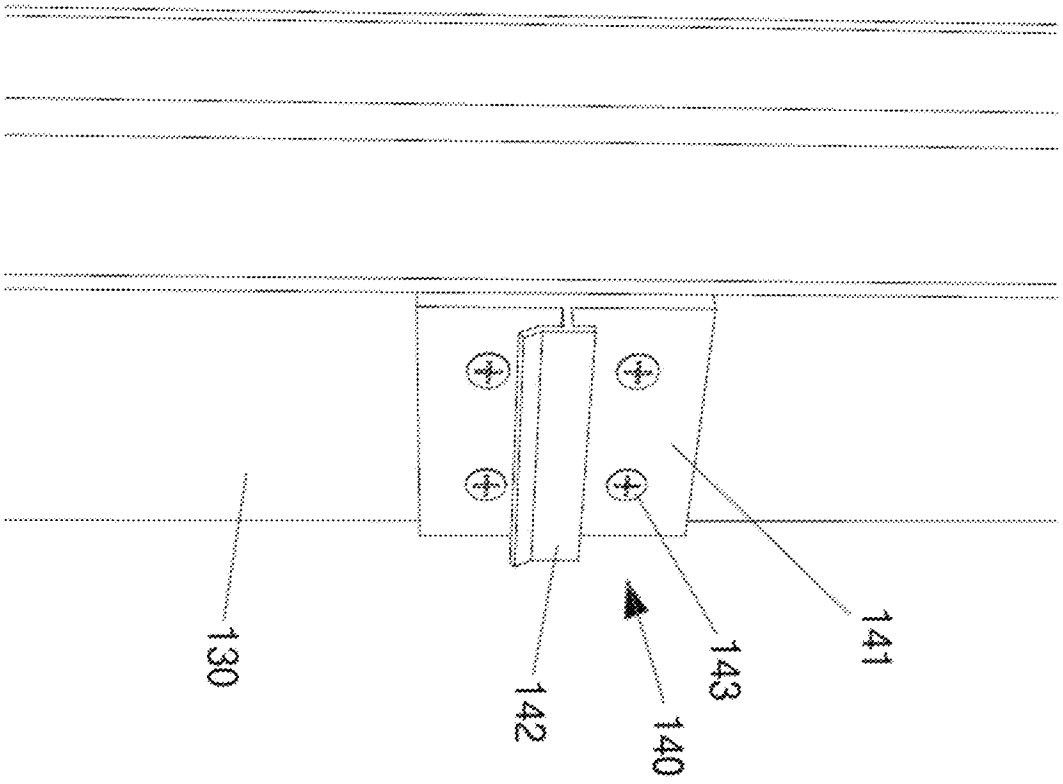
Figure 11C:
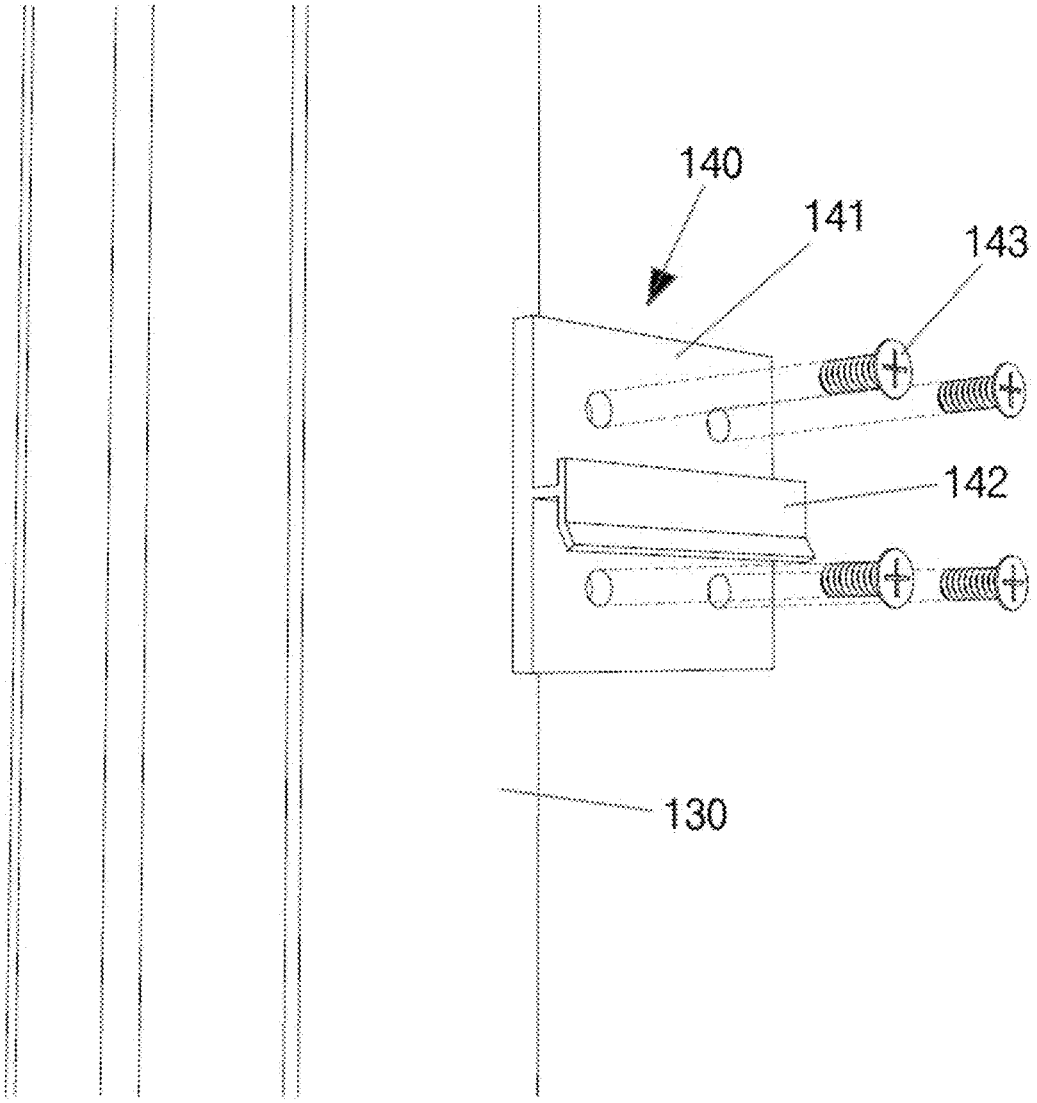

FIGS. 11A to 11C are a cross-sectional views and perspective views illustrating a state where the exterior fixing material 140 is fixed in each of the Tetris houses 100 and 100A according to the present disclosure.

As illustrated in FIGS. 11A to 11C, the exterior fixing material 140 in each of the Tetris houses 100 and 100A can be directly fixed to the surface of the structural material 110, the connector 120, and/or the H beam 13 through the bolts 143 or the like.

The plurality of Tetris houses 100 and 100A may be coupled to each other by the exterior fixing materials 140, or a substructure such as a window, a door, or a wall structure may be easily installed inside the Tetris houses 100 and 100A by the exterior fixing materials 140. A reference numeral 132 (not described) in the drawing is a second insulating material such as the neoprene surrounding the H beam 130.

Figure 12A:
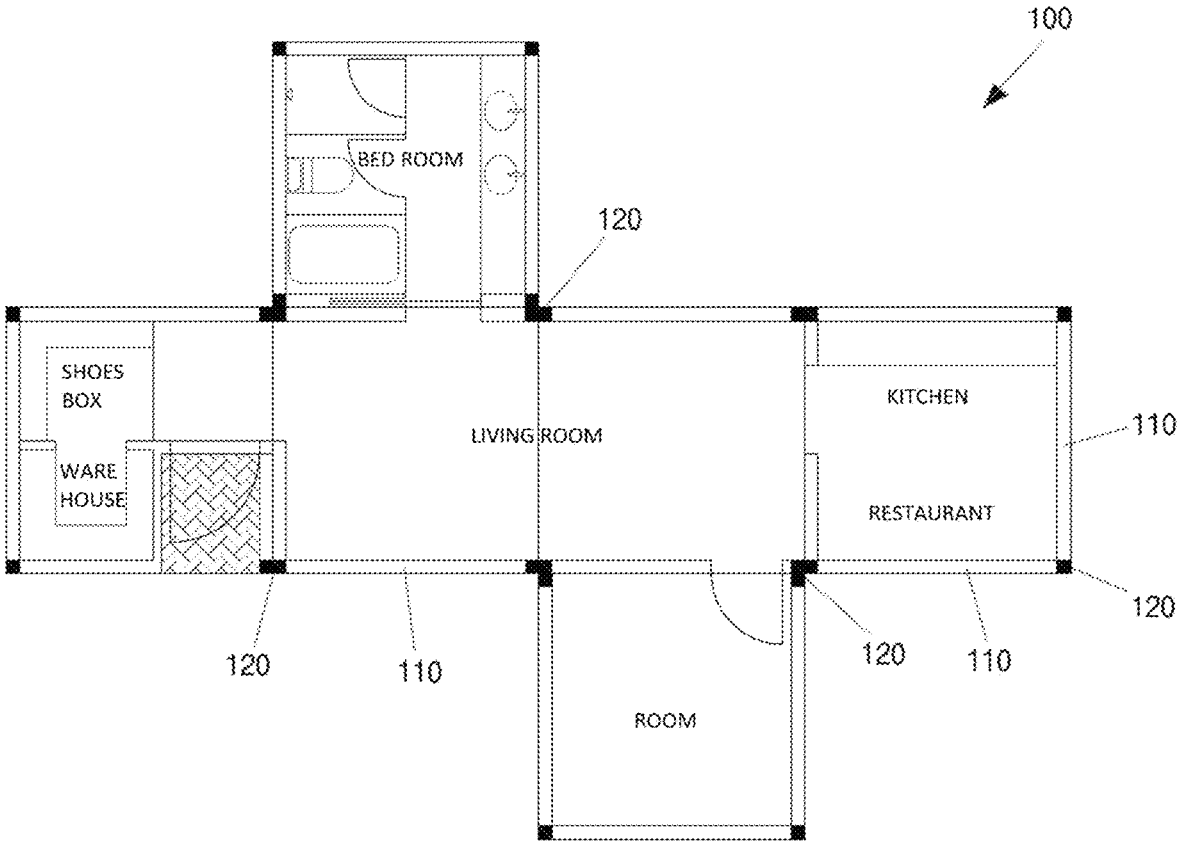
FIGS. 12A and 12B are a plan view and a perspective view illustrating an example of the Tetris house according to the present disclosure.
Figure 12B:
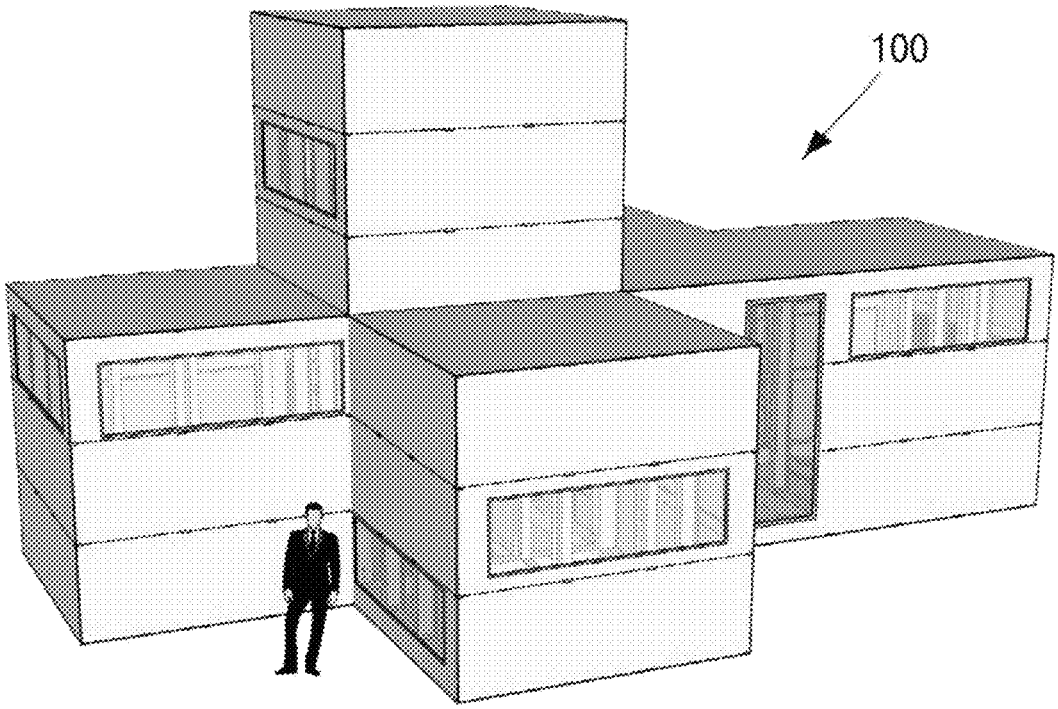

FIGS. 12A and 12B are a plan view and a perspective view illustrating an example of the Tetris house 100 according to the present disclosure.

As illustrated in 12A, the Tetris house 100 includes a room, a living room, a kitchen, a restaurant, a warehouse, a shoebox, a toilet, or the like, which are individually provided and then, assembled to each other to form a single house.

In addition, as illustrated in FIG. 12B, the Tetris house 100 may be assembled not only on the first floor, but also on two or more floors. In particular, one unit of the Tetris house 100 is formed in a substantially hexahedral shape or rectangular parallelepiped shape, and thus, a multi-layered house using the Tetris house 100 has a high strength and excellent seismic performance.

The above-described Tetris house is only one embodiment for implementing the Tetris house according to the present disclosure. Accordingly, the present disclosure is not limited to the above-described embodiment, and the present invention may include various changes which can be implemented by anyone who has ordinary knowledge in the field to which the present invention belongs without departing from the gist of the present disclosure as claimed in the claims below.

The present disclosure provides the Tetris house. The present disclosure provides the Tetris house in which the structural material and the insulating material are coupled with each other to further save a space. The present disclosure also provides the Tetris house in which the outside of the structural material is treated with the neoprene to prevent the heat bridge between the inside and outside and prevent condensation. The present disclosure also provides the Tetris house in which the neoprene surrounding the structure material may be finished with the zipper or Velcro, the structural material is easily finished with the neoprene, and particularly, the zipper or Velcro is finished with the neoprene again, and thus, the structural material is completely surrounded by the neoprene.

In particular, the present disclosure also provides the structural material of the Tetris block type modular house of approximately 3×3×3m, and thus, provides an optimal material size calculated through the seismic design. In addition, an inside of a building structure calculated by the seismic design is filled with the insulating material. Accordingly, an energy-saving standard is satisfied, and the heat bridge is prevented by attaching a foam rubber material (for example, neoprene) to the outside of the building structure. In addition, when the structure is surrounded by the foamy rubber material, the foamy rubber material covers the structural material like clothes using the zipper or Velcro, and thus, when the structural material is disassembled, the zipper or Velcro can be reused to have an environmental function. Moreover, the H-beam intersecting between the structural materials is a member for fixing finishing materials inside and outside the building, and is formed of polycarbonate to block the heat bridge. In addition, all members are fixed by a bolt and a nut for easy fixing/coupling and disassembly.

What is claimed is:

1. A block type modular house comprising:

a plurality of structural materials which are installed in regions corresponding to respective sides of a hexahedron; and a connector which is installed in a region corresponding to each corner of the hexahedron to connect adjacent structural materials to each other, wherein the structural material includes a metal pipe, a first insulating material with which an inside of the metal pipe is filled, and a second insulating material which surrounds an outside of the metal pipe, wherein the second insulating material is finished with a zipper, wherein a plastic H beam comprising a web part and two flanges is coupled between the structural materials facing each other, wherein the plastic H beam includes protrusions formed on the web part of an upper end, and a lower end thereof, respectively, and wherein the second insulating material includes neoprene.

2. The block type modular house of claim 1, wherein the connector includes three to six openings to which the structural material is coupled, and an angle between the openings adjacent to each other is 90° or 180°.

3. The block type modular house of claim 1, wherein the connector includes a metal pipe, a first insulating material with which an inside of the metal pipe is filled, and a second insulating material which surrounds an outside of the metal pipe.

4. The block type modular house of claim 1, wherein the metal pipe includes steel, the first insulating material includes an urethan foam.

5. The block type modular house of claim 1, wherein the zipper is covered with a protective tape.

6. The block type modular house of claim 1, wherein the structural material and the connector are coupled to each other by a bolt and a nut.

7. The block type modular house of claim 6, wherein the bolt and the nut are covered with the second insulating material.

* * * * *